United States Patent [19]

Theurer

[11] 4,355,579

[45] Oct. 26, 1982

[54] TRACK TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 207,336

[22] Filed: Nov. 17, 1980

[30] Foreign Application Priority Data

Dec. 12, 1979 [AT] Austria ..... 7847/79

[51] Int. Cl.[3] ..... E01B 27/16

[52] U.S. Cl. ..... 104/12

[58] Field of Search ..... 104/7, 8, 12

[56] References Cited

U.S. PATENT DOCUMENTS

| | | | |
|---|---|---|---|
| 3,608,496 | 9/1971 | Schenkir et al. | 104/12 |
| 3,621,786 | 11/1971 | Joy | 104/12 |
| 3,797,397 | 3/1974 | Eisenmann | 104/12 |
| 4,094,251 | 6/1978 | Theurer | 104/12 |
| 4,258,627 | 3/1981 | Theurer | 104/12 |

*Primary Examiner*—Richard A. Bertsch
*Attorney, Agent, or Firm*—Kurt Kelman

[57] ABSTRACT

The tamping head of a mobile track tamper comprises two pairs of reciprocable ballast tamping tool implements, each pair being arranged at a respective side of each track rail, a reciprocating power drive for the ballast tamping tool implements of each pair, a carrier part associated with the ballast tamping tool implements, a pivot extending in the direction of elongation of the machine and supporting the carrier part for pivoting in a plane extending transversely thereto, and a vibrating power drive connected to the carrier part and imparting to the tamping tool implements an oscillatory vibrating motion in a plane extending perpendicularly to the pivot in each position of the tamping tool implements.

10 Claims, 5 Drawing Figures

TRACK TAMPER

The present invention relates to a mobile track tamper comprising a frame arranged on a track consisting of a multiplicity of ties and two rails fastened to the ties, the rails intersecting each tie at respective points of intersection and ballast supporting the track rails at each point of intersection, and a tamping head vertically movably mounted on the frame for vertical alignment with the respective point of intersection. The tamping head includes a carrier supporting two pairs of ballast tamping tool implements arranged for reciprocating in the direction of track elongation towards and away from each other and a respective one of the ties positioned between the tamping tool implements of each pair, each pair of the ballast tamping tool implements being arranged at a respective side of each rail in a direction transverse to the track and the ballast tamping tool implements being immersible in the ballast upon vertical movement of the tamping head for tamping ballast under the respective tie upon reciprocation of the implements. The tamping head further includes a reciprocating power drive for the ballast tamping tool implements of each pair and a vibrating power drive means for imparting vibrating motion to the implements.

Tamping heads of this general type and incorporating a great variety of tamping tool structures and drives are well known, many of them using the basic principle of directly superimposing the reciprocatory and vibratory motions for imparting a resultant compound movement to the tamping tool implements about the pivots supporting the implements for reciprocation. Tamping heads incorporating this principle have been very successful in track maintenance work.

British patent No. 1,037,520, published July 27, 1966, discloses tamping tools which may be power-driven in a plane extending perpendicularly to the track to enable the operating range of the tools to be changed in this plane, if desired, and thus to make it possible to increase the operating width of the tools.

According to Austrian patent No. 199,216, publicly available on Aug. 25, 1958, an additional oscillatory motion extending perpendicularly to the path of movement of the tamping plates of the tamping tools is superimposed on the compound reciprocatory and vibrating closing movement of the tools. This arrangement, too, is designed to enlarge the effective operating range of the tamping plates. The particular disadvantage of the structure disclosed in this patent resides in the fact that the tamping tools connected to the reciprocating and vibrating drives are individually mounted on driven threaded spindles extending transversely to the track for imparting the additional oscillatory motion to the tools. These driven spindles are directly subjected to the vibrations generated by the vibrating drive and the drives for the spindles must constantly be reversed to produce the oscillatory motion.

U.S. Pat. No. 3,011,454, dated Dec. 5, 1961, discloses a tamping head whose tamping tool carrier has a support frame vertically movably mounted on vertical guide columns on the machine frame, the carrier being pivotal on the support frame about a vertical axis and a vibrating drive connecting the carrier to the support frame. In this arrangement, the tamping plates of the tamping tools operate in an oscillatory movement in an arcuate path about the vertical axis. Since the radius of this arcuate path corresponds to about half the width of a crib and is relatively small (about 30 cm), the tamping tool carrier must be pivoted through a relatively large angle to obtain a sufficiently effective vibrating amplitude of the ballast tamping plates. This gives rise to considerable mass forces during the vibration of the tamping tool carrier since the carrier with its tamping tools and drives is quite massive, and these forces subject the pivots for the carrier and also the machine frame receiving these forces through the support frame to undue wear. Furthermore, this structure cannot be used at all for tamping heads with tamping tool arrangements designed for the simultaneous tamping of more than one tie because the paths of movement of the tamping plates of the various tamping tools spaced in the direction of track elongation would differ in dependence of their distance from the vertical pivoting axis of the carrier, thus producing different vibrating amplitudes. Such tamping heads are so heavy that the previously discussed mass forces could not be handled at all.

German patent application No. 1,759,950, published Jan. 28, 1971, discloses a track tamper of a different type, i.e. a machine equipped with vibratory surface tampers for compacting the ballast in the cribs between ties.

It is the primary object of this invention to improve the successfully used tamping heads in mobile track tampers of the first-described structure so as to enhance the compaction of the ballast under the ties at the points of intersection of ties and rails and thus to stabilize the position of the tamped track considerably while keeping the tamping tool and drive structures that have been found useful in practice.

In a mobile track tamper comprising a tamping head of this type, the above and other objects are accomplished according to the invention with a carrier part to which the ballast tamping tool implements are connected, a pivot extending in the direction of elongation of the machine and supporting the carrier part for pivoting in a plane extending transversely of this direction, and a vibrating power drive means connected to the carrier part and imparting to the tamping tool implements an oscillatory vibrating motion in a plane extending perpendicularly to the pivot in each position of the tamping tool implements.

In an unexpectedly simple manner, this arrangement for the first time produces ballast supports of almost homogenous density and enhanced compaction of the ballast pieces because of the stabilizing effect of the tamping plates oscillating transversely to the track in planes extending perpendicularly to the pivots of the carrier part. This stabilizing effect is produced by imparting to the ballast pieces in the operating range of the tamping plates not only a pushing motion towards the ties during the reciprocation of the tamping tools but also a transverse oscillatory vibrating motion instead of merely vibrating the ballast pieces in the direction of reciprocation, as has been conventional. This transverse oscillatory vibrating motion is transmitted with increased force to laterally adjacent ballast pieces and moves the ballast in an increased region wherein the individual ballast pieces are better oriented and thus move more closely together for improved compaction of the ballast in this increased region. This highly densified ballast is moved under the ties by the reciprocation of the tamping tools so as to produce a very firm ballast support for the track rails at the points of intersection of ties and rails and these supports are highly resistant to the dynamic loads to which passing trains subject the track.

Furthermore, the transverse vibration of the tamping tools produces not only an increase of the operating width of the tools, which is of particular importance in the tamping of track switches and crossings, but also considerably reduces the resistance encountered by the tamping plates during their penetration into and movement in the ballast since the vibrating motion extends essentially in the direction of the smallest cross section of the tamping plates. This reduces the energy required for the vibrating drive. The very firm ballast supports produced with the arrangement of the present invention greatly reduces the track settling time usually encountered on newly tamped track when train traffic is resumed.

The tamping head construction of this invention has the further advantage of enabling the reciprocating and vibrating power drives to be arranged independently, which gives a broader range to the selection of specific drives and also avoids subjecting the reciprocating drive to vibrations.

The above and other objects, advantages and features of this invention will become more apparent from the following detailed description of certain now preferred embodiments thereof, taken in conjunction with the accompanying schematic drawing wherein FIG. 1 shows an over-all side elevational view of a mobile track tamper comprising the tamping head of the invention;

Figure 1:
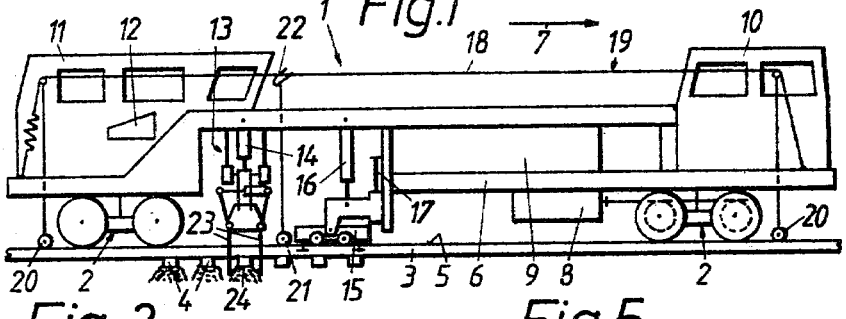

Referring now to the drawing and first to FIG. 1, there is shown generally conventional track leveling and tamping machine 1 comprising frame 6 arranged on track 5 consisting of a multiplicity of ties 4 and two rails 3 fastened to the ties, the rails intersecting each tie at respective points of intersection and ballast 24 supporting the track rails at each point of intersection. The machine frame is supported on undercarriages 2 illustrated as double-axled swivel trucks for movement on track 5 in an operating direction indicated by arrow 7. The machine is self-propelled, for which purpose drive 8 is mounted on frame 6 and a transmission connects the wheels of front undercarriage 2 to the drive for driving the wheels. Housing 9 on frame 6 contains the power plant for the machine and operator's cabs 10 and 11 are mounted at the front and rear ends of the machine frame. Central control panel 12 is arranged in rear operator's cab 11.

Tamping head 13 is vertically movably mounted on frame 6 for vertical alignment with the respective point of intersection of each rail 3 with the ties. Power drive 14 illustrated as a hydraulic motor connects each tamping head to the machine frame for vertical movement of the tamping head and, as shown, the tamping heads are arranged on the frame within view of cab 11. Track lifting unit 15 including rail gripping lifting and lining rollers is mounted on the machine frame in front of the tamping heads and is vertically movably supported on vertical guide columns 17. Power drive 16 illustrated as a hydraulic motor connects the unit to frame 6 for vertical movement of the track lifting unit.

For track leveling, machine 1 is further equipped with reference system 19 comprised of reference wire 18 tensioned between two ends points which are floatingly guided on track 5 by rail sensing elements 20, 20, another rail sensing element 21 being guided on the track between tamping head 13 and lifting unit 15, this sensing element supporting wire sensor 22, which may be a rotary potentiometer, for producing a leveling control signal for actuating drive 16. All of the heretofore described structure is conventional and functions in a manner well known to those skilled in the art.

Figure 2:
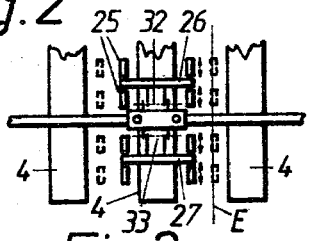
FIG. 2 is a diagrammatic top view of the arrangement of the pairs of tamping tool implements of the tamping head of FIG. 1 in vertical alignment with a respective point of intersection of a track rail and tie.

Each tamping head includes carrier 31 supporting two pairs of ballast tamping tool implements 23 arranged for reciprocation in the direction of track elongations towards and away from each other and a respective tie 4 positioned between the tamping tool implements of each pair. As shown diagrammatically in FIG. 2, which only shows tamping plates 25 of the tamping tool implements, each pair of ballast tamping tool implements 23 is arranged at a respective side of each rail 3 in a direction transverse to track 5 and the ballast tamping tool implements are immersible in the ballast upon vertical movement of the tamping head for tamping ballast under respective tie 4 upon reciprocation of the implements. In the illustrated embodiment, each tamping tool implement has two laterally adjacent tamping plates 25. Reciprocating power drive 47 (which will be more fully described hereinafter) enables the tamping tool implements of each pair to be reciprocating between a closed position shown in FIG. 1 and in full lines in FIG. 2, and an open position shown in FIG. 2 in broken lines. Ballast tamping tool implements 23 are connected to carrier parts 26, 27, the illustrated embodiment providing a respective carrier part supporting the ballast tamping tool implements on each side of the rail. In the illustrated embodiment, carrier parts 26 and 27 are arranged symmetrically with respect to a respective rail 3 with which tamping head 13 is associated. A respective pivot 32, 33 extends in the direction of elongation of the machine and supports respective carrier part 26, 27 for pivoting in a plane extending transversely of this direction. Vibrating power drive means 35 (which will be described in detail hereinafter) is connected to the carrier part and imparts to the tamping tool implements an oscillatory vibrating motion in plane E (or a vertical plane parallel thereto) extending perpendicularly to the pivot in each position of the tamping tool implements.

Supporting all the tamping tool implements on each side of rail 3 commonly on a respective carrier part 26, 27 to form a structural unit provides the same movements for all the implements even when a number of spaced tamping tool implements are used, for instance two pairs of the tools spaced from each other for the simultaneous tamping of two adjacent ties. The symmetrical construction provides the same motion and force conditions for the pairs of tamping tool implements on each side of the rail.

Figure 3:
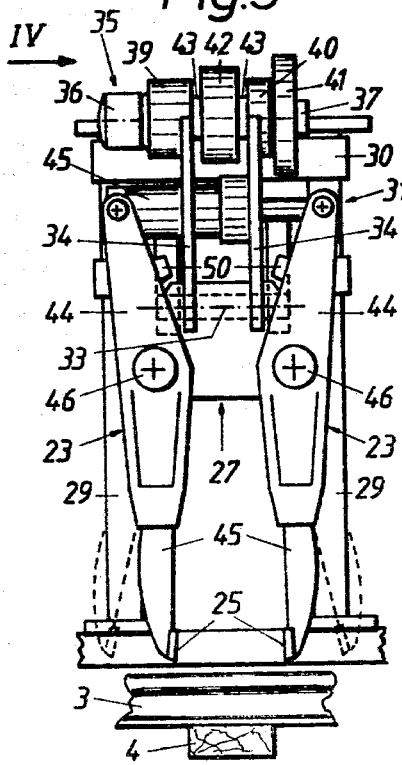
FIG. 3 is an enlarged side elevational view of the tamping head.
Figure 4:
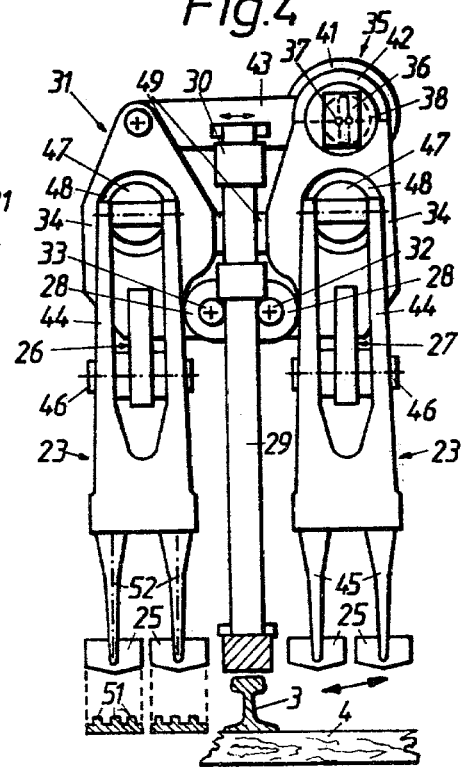
FIG. 4 is an end view of the tamping head seen in the direction of arrow IV of FIG. 3.

In the preferred embodiment illustrated in FIGS. 3 and 4, tamping tool implement carrier 31 is mounted on central vertical guide column 29 between symmetrically arranged carrier parts 26 and 27. Pivot 46 supports each tamping tool implement 23 for reciprocation on the respective carrier part supporting the respective pair of the ballast tamping tool implements. Pivots 32,

33 supporting carrier parts 26, 27 are mounted on carrier 31 above pivots 46 and bearing lug 28 mounts each carrier part on respective pivot 32, 33, the bearing lugs extending from central carrier guide part 30 which is vertically movably mounted on the central guide column. This separate mounting of the two carrier parts enables the pivots supporting the carrier parts to be located according to the desired conditions of movement and amplitudes of vibration of the tamping tool implements transversely to the track.

As shown, the vibrating power drive means of the illustrated and preferred embodiment is single power drive 35 connected to each carrier part 26, 27 for imparting the oscillatory vibrating motion to all the tamping tool implements 23. Each carrier part includes driving arm 34 extending upwardly from the carrier part and having an upper end. The single vibrating power drive is linked to the upper ends of the carrier parts. This vibrating drive arrangement is not only relatively light and space-saving but also causes the tamping tool implements on the left and right side of the rail to be vibrated in opposite directions, thus fully balancing the vibratory forces and relieving the machine frame of vibration.

Illustrated drive 35 includes engine-driven eccenter or crank shaft 37 journaled on the driving arm of carrier part 27, the shaft having eccentric or crank portion 38. Connecting links 43 have one end connected to carrier part 26 and another end mounted on eccentric or crank portion 38 of the shaft. This construction makes use of the widely accepted crank shaft arrangements used in the art of vibrating tamping tools, requiring only one crank shaft portion for producing the desired vibration of both carrier parts and thus further simplifying the vibrating drive structure. The engine used for driving shaft 37 may be an oil motor 36.

Eccenter or crank shaft 37 is journaled in bearings 39 and 40 at the upper end of driving arm 34 of carrier part 27. Flywheel 41 is keyed to the shaft end opposite oil motor 36. Eccentric ring 42 mounted at crank portion 38 is linked to the upper ends of driving arms 34 of opposite carrier part 26 by two connecting links 43 extending transversely to pivots 32 and 33.

Illustrated tamping tool implement 23 has pivotal tool holder arm 44 and tamping tool 45 replaceably mounted in the tool holder arm. Pivot 46 supports the pivotal tool holder of each implement on a respective carrier part 26, 27 and the pivotal tool holders of the implements of each pair are connected by reciprocating power drive 47. As is entirely conventional, the power drive may be a hydraulic cylinder-piston unit mounted in circular bores 48 in driving arms 34 and linked to the upper ends of the driving arms.

As has been shown in a sectional projection of tamping plates 25 at the lower left of FIG. 4, it is preferred to use tamping plates having ribs 51 protruding from the tool axes 52 in the direction of reciprocation and perpendicularly to the plane in which the tamping plates extend for oscillatory vibration transversely to the track. Functionally equivalent to the ribbed cross section illustrated, the working face of the tamping plates may be sinuous or of zick-zack shape. This tamping plate profile considerably enhances the previously described effect of the oscillatory vibrating motion in orienting the ballast pieces and correspondingly increasing the density of the ballast. The surface projections or ribs cause the ballast pieces in contact therewith to be vibrated and to be pushed between the surrounding ballast pieces. Thus the volume of the ballast is decreased and the very dense ballast is pushed under the adjacent tie by the reciprocation of the tamping tools. The resultant ballast support is exceedingly firm because of its high compaction.

In the illustrated embodiment, a pair of elastic abutments 49, 49, which may be rubber buffers, are mounted on carrier 31 and cooperate with guide column 29 and carrier parts 26, 27 for centering the carrier parts in end positions of the oscillatory vibrating motion (see FIG. 4). Furthermore, elastic abutments 50 are provided on the facing sides of pivotal arms 44 of ballast tamping tool implements 23 to cooperate with the opposing faces of driving arms 34 of the carrier parts. These abutments (see FIG. 3) center the tools of each part in the open position of the tools indicated in broken lines in FIG. 3. Elastic abutments 49 assure a symmetrical oscillatory vibrating movement of the two carrier parts with respect to a vertical center plane of carrier 31 and this movement has essentially the same amplitude at both sides, thus assuring a uniform transmission of the vibrating forces to the regions of the cribs at the left and right sides of the rail.

Figure 5:
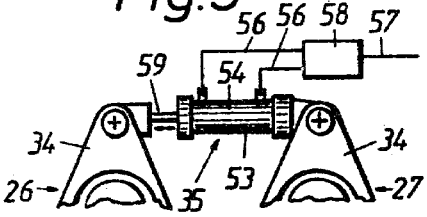
FIG. 5 is a fragmentary end view showing another embodiment of the vibrating power drive.

FIG. 5 shows another modification of vibrating power drive means 35. This drive means is comprised of a pressure fluid, i.e. hydraulically, operated unit 53 including cylinder 54 and piston rod 59 reciprocal in the cylinder under fluid pressure and a source of fluid pressure pulses connected to the cylinder, cylinder 54 being linked to carrier part 27 and piston rod 59 being linked to carrier part 26, the pivotal connections of unit 53 to the carrier parts being made at the upper ends of their drive arms 34. As shown, pressure fluid conduit 57 delivers the pressure fluid from a reservoir (not shown) and control valve 58 is interposed between fluid pressure source 57 and pressure fluid conduits 55 and 56 respectively connected to the two cylinder chambers on the respective sides of a piston reciprocating in the cylinder. The valve is operated at an adjustable frequency to deliver pressure fluid pulses alternatively to one and the other chamber for producing an oscillatory motion. In this manner, carrier parts 26 and 27 are subjected to opposite vibrations of the same phase, as in the previously described embodiment of the vibrating drive. This linear vibrating drive has advantages with respect to the simplification of the hydraulic system of the machine and, furthermore, requires very little space and no additional mechanical transmission of the vibratory motion to the carrier parts.

The track tamper hereinabove described and illustrated in the accompanying drawing operates essentially in the following manner:

At the beginning of the tamping operation, oil engines 36 are actuated to operate vibrating power drives 35 of tamping heads 13. This imparts to carrier parts 26, 27 and tamping tool implements 23 connected thereto an oscillatory vibrating motion with opposite vibrations of the same phase in a plane extending perpendicularly to pivots 32, 33 in each position of the tamping tool implements. This transverse vibratory motion of tamping plates 25 is shown by the double-headed arrow in FIG. 4. Depending on the eccentricity of crank portion 38 of shaft 37 and on the selected position of pivots 32, 33, the tamping plates are subjected to a pre-selected amplitude of vibrations along an arcuate path of a given radius. After ballast tamping tool implements 23 are properly centered over a respective tie 4 to be tamped, vertical adjustment drive 14 is actuated to lower tamping heads 13 and to immerse tamping plates 25 in the ballast in the two cribs on either side of the tie. Since the oscillatory vibratory motion extends in the direction of the smallest cross sectional dimension of the tamping plates, the plates will encounter relatively little resistance at the immersion in the ballast. After immersion, reciprocating drives 47 are actuated to close the tamping tool implements in a pincer-like movement towards the tie positioned between the implements of each pair. Thus, tamping plates 25 will impart to the ballast pieces in their range movements in the direction of track elongation as well as transversely thereto, thus compressing the ballast to the smallest possible volume in the manner hereinabove described more fully. The resultant ballast supports 24 for the track are exceedingly firm and long-lasting.

While the invention has been described in connection with certain now preferred structural embodiments, these may be greatly varied and may be adapted, for example, to tamping heads with tamping tools designed for tamping more than one tie, i.e. with two or more pairs of reciprocating tamping tools spaced in the direction of track elongation. Furthermore, rather than using pairs of reciprocatory tamping tools which are closed against a tie positioned therebetween, the tools of the pairs may be immersed in a crib and may be opened towards the two ties adjacent the crib. Also, switch tampers may be provided with tamping tools which may be laterally pivoted away from the track. In addition, when more than one pair of tamping tools is provided at each side of the rail, each pair may be connected to a separate carrier part. If desired, a separate vibrating drive may be connected to each carrier part, rather than using a common drive.

What is claimed is:

1. A mobile track tamper comprising a frame arranged on a track consisting of a multiplicity of ties and two rails fastened to the ties, the rails intersecting each tie at respective points of intersection and ballast supporting the track rails at each point of intersection, and a tamping head vertically movably mounted on the frame for vertical alignment with the respective points of intersection, the tamping head including (a) a carrier supporting two pairs of ballast tamping tool implements arranged for reciprocation in the direction of track elongation towards and away from each other and a respective one of the ties positioned between the tamping tool implements of each pair, each pair of the ballast tamping tool implements being arranged at a respective side of each rail in a direction transverse to the track and the ballast tamping tool implements being immersible in the ballast upon vertical movement of the tamping head for tamping ballast under the respective tie upon reciprocation of the implements, (b) a reciprocating power drive for the ballast tamping tool implements of each pair, (c) a respective carrier part supporting a respective one of the pairs of the ballast tamping tool implements on each side of the rail, (d) a pivot extending in the direction of elongation of the machine and supporting the carrier part on the carrier for pivoting in a plane extending transversely of said direction, and (e) a vibrating power drive means connected to the carrier part and imparting to the tamping tool implements an oscillatory vibrating motion in a plane extending perpendicularly to the pivot in each position of the tamping tool implements.

2. The mobile track tamper of claim 1, wherein a respective one of the carrier parts supports the ballast tamping tool implements on each side of the rail.

3. The mobile track tamper of claim 1, wherein the carrier parts are arranged symmetrically with respect to a respective one of the rails with which the tamping head is associated, and a respective one of the pivots supporting each carrier part.

4. The mobile track tamper of claim 3, further comprising a central vertical guide column between the symmetrically arranged carrier parts, the tamping tool implement carrier being vertically adjustably mounted on the guide column, the respective pivot supporting each tamping tool implement for reciprocation on the respective carrier part and a bearing lug pivotally mounting each respective pivot.

5. The mobile track tamper of claim 3, wherein the vibrating power drive means is a single power drive connected to each carrier part for imparting the oscillatory vibrating motion to all the tamping tool implements.

6. The mobile track tamper of claim 5, wherein each carrier part includes a driving arm extending upwardly from the carrier part and having an upper end, and the single vibrating power drive is linked to the upper ends of the carrier parts.

7. The mobile track tamper of claim 6, wherein the single vibrating power drive includes an engine-driven eccenter shaft journaled on one of the carrier parts, the eccenter shaft having an eccentric portion, and further comprising a connecting link having one end connected to the other carrier part and another end mounted on the eccentric shaft portion.

8. The mobile track tamper of claim 1, wherein each tamping tool implement has a pivotal tool holder arm and a tamping tool replaceably mounted in the tool holder arm, the tamping tool including a tamping plate extending in said plane for oscillatory vibration transversely to the track, and the tamping plate having ribs protruding in the direction of reciprocation.

9. The mobile track tamper of claim 1, wherein the vibrating power drive means is comprised of a pressure fluid operated unit including a cylinder and a piston rod reciprocable in the cylinder under fluid pressure and a source of pressure fluid pulses connected to the cylinder, the cylinder being linked to one of the carrier parts and the piston rod being linked to the other carrier part.

10. A mobile track tamper comprising a frame arranged on a track consisting of a multiplicity of ties and two rails fastened to the ties, the rails intersecting each tie at respective points of intersection and ballast supporting the track rails at each point of intersection, and a tamping head vertically movably mounted on the frame for vertical alignment with the respective points of intersection, the tamping head including (a) a carrier supporting two pairs of ballast tamping tool implements arranged for reciprocation in the direction of track elongation towards and away from each other and a respective one of the ties positioned between the tamping tool implements of each pair, each pair of the ballast tamping tool implements being arranged at a respective side of each rail in a direction transverse to the track and the ballast tamping tool implements being immersible in the ballast upon vertical movement of the tamping head for tamping ballast under the respective tie upon reciprocation of the implements, (b) a reciprocating power drive for the ballast tamping tool implements of each pair, (c) a respective carrier part supporting a respective one of the ballast tamping tool implements on each side of the rail, the carrier parts being arranged symmetrically with respect to a respective one of the rails with which the tamping head is associated, (d) a respective pivot extending in the direction of elongation of the machine and each one of the pivots supporting a respective one of the carrier parts on the carrier for pivoting in a plane extending transversely of said direction, (e) a vibrating power drive means connected to the carrier part and imparting to the tamping tool implements in oscillatory vibrating motion in a plane extending perpendicularly to the pivot in each position of the tamping tool implements.

(f) a central vertical guide column between the symmetrically arranged carrier parts, the tamping tool implement carrier being vertically adjustably mounted on the guide column, a respective pivot supporting each tamping tool implement for reciprocation on the respective carrier part, and (g) a pair of elastic abutments mounted on the carrier and cooperating with the guide column and the carrier parts for centering the carrier parts in end positions of the oscillatory vibrating motion.

* * * * *